United States Patent [19]

Walker, III

[11] 4,063,206

[45] Dec. 13, 1977

[54] TUNABLE ELECTRICAL COMPONENT

[76] Inventor: Edgar Walker, III, Lot No. 16, Cedar Lake Village, Mount Washington, Ky. 40047

[21] Appl. No.: 714,478

[22] Filed: Aug. 16, 1976

[51] Int. Cl.[2] ..... H01F 29/02

[52] U.S. Cl. ..... 336/45; 336/65; 336/144; 336/192; 343/750

[58] Field of Search ..... 336/45, 144, 192, 65; 361/300; 338/164, 196; 343/715, 749, 750, 888, 900, 905, 906, 895

[56] References Cited

U.S. PATENT DOCUMENTS

| | | | |
|---|---|---|---|
| 1,676,744 | 7/1928 | Pickard | 336/45 X |
| 1,904,208 | 4/1933 | Dow | 336/45 X |
| 2,290,508 | 7/1942 | Usselman et al. | 361/300 |
| 2,649,577 | 8/1953 | Armstrong | 336/144 X |
| 2,764,742 | 9/1956 | Cady et al. | 336/144 X |
| 2,894,260 | 7/1959 | Ellis | 343/750 X |
| 3,267,476 | 8/1966 | Finke | 343/715 |
| 3,729,817 | 5/1973 | Rouen et al. | 338/164 X |

FOREIGN PATENT DOCUMENTS

| | | | |
|---|---|---|---|
| 738,669 | 12/1932 | France | 361/300 |

OTHER PUBLICATIONS

A.P.C. Application of Bassett, Serial No. 551,049 published Aug. 23, 1949.

*Primary Examiner*—Thomas J. Kozma
*Attorney, Agent, or Firm*—Maurice L. Miller, Jr.

[57] ABSTRACT

An electrical component such as a base loading coil assembly for a fixed length mobile radio antenna is disclosed featuring an electrical coil having a series of windings and an adjustable shorting screw disposed in line with the longitudinal axis of the coil and being rotatable on at least a portion of the windings so as to translate along the longitudinal axis of the coil to vary the inductance thereof.

11 Claims, 6 Drawing Figures

TUNABLE ELECTRICAL COMPONENT

BACKGROUND OF THE INVENTION

In the near future the Federal Communications Commission proposes to increase the number of available channels of citizens band usage to as high as 56. The expanded channels of communication make desirable a base loading coil assembly which is accurately tunable over a wide range of inductance values so as to permit the tuning of a single fixed length mobile transceiver antenna to a wide range of resonant frequencies. Such loading coil assemblies as are now known in the prior art often do not permit continuous accurate variation of inductance over such a wide inductance range, nor do they provide simple and accurate means for adjustment to specific inductance values on a repetitive basis. Also, moisture seepage into tunable antenna loading coils has been a problem in the prior art. My invention substantially overcomes these other difficulties known in the prior art.

SUMMARY OF THE INVENTION

Briefly, it is an object of my invention to provide an electrical component featuring a coil of electrically conductive material having a plurality of windings, and an adjustable shorting screw disposed in line with the longitudinal axis of the coil and being adapted to rotate on at least a portion of the windings and translate along the longitudinal axis thereof to vary the electrical inductance of the coil.

This and other objects of my invention will become apparent to those skilled in the art from the following detailed description and attached set of drawings, on which, by way of example, only the preferred embodiments of my invention are illustrated.

DESCRIPTION OF THE PREFERRED EMBODIMENTS

Figure 1:
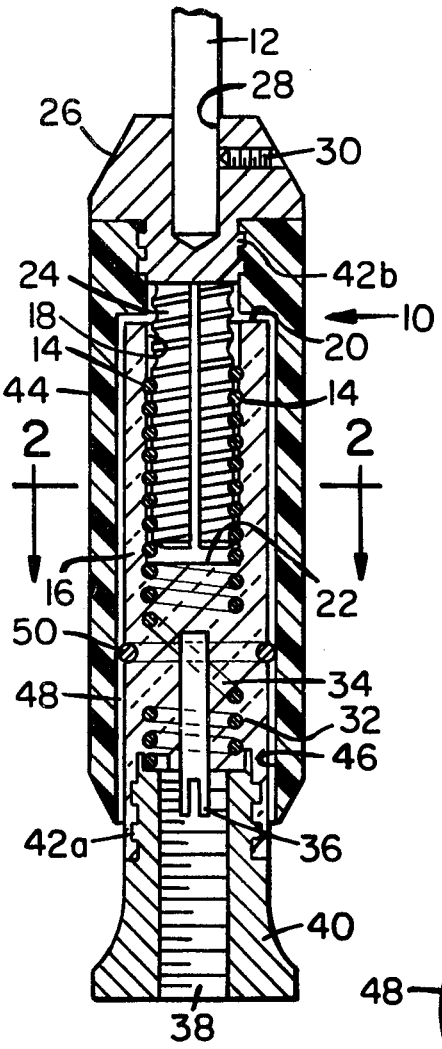
FIG. 1 is a cross-sectional elevation view of a tunable base loading coil assembly for a radio antenna, illustrating one preferred embodiment of my invention.
Figure 2:
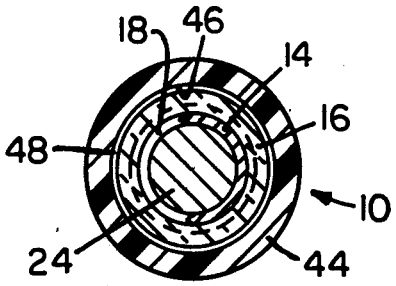
FIG. 2 is a view in cross-section of the assembly shown in FIG. 1 as viewed along lines 2—2 of the latter figure.
Figure 3:
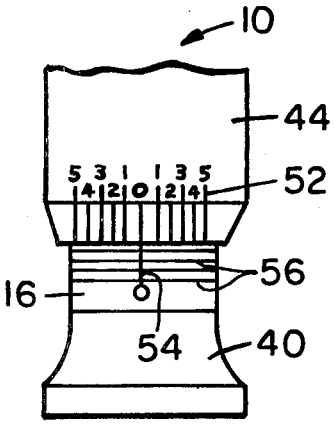
FIG. 3 is a fragmented elevation view of the assembly of FIGS. 1-2.

Referring now to FIGS. 1-3 there is shown, in accordance with my invention, an electrical component consisting of a tunable base loading coil assembly 10 for a vertical mobile radio antenna 12. A first coil 14 having a plurality of windings forming a helix and consisting of an electrically conductive material such as, for example, copper wire, is partially embedded in a mass 16 of suitable electrically insulative dielectric material such as plastic, polycarbonate resin, glass or the like. A suitable dielectric material is that manufactured by the General Electric Company under the trade name, "Lexan", or the equivalent. The mass 16 of the present example is formed in the shape of an elongated cylinder by any well-known process such as by injection molding or the like so as to define a hollow shaft 18 therein which opens onto the top end 20 of the mass 16. The coil 14 is partially embedded in the mass 16, at least a portion of the windings of which are partially embedded in and extend around the defining wall of the shaft 18. The remainder of the windings of the coil 14 not partially embedded in the defining wall of the shaft 18 may extend, as shown on FIG. 1, into the core of the mass 16 below the bottom 22 of the shaft 18.

An adjustable shorting screw 24, being grooved and threaded so as to conform to the pitch, spacing and diameter of the coil 14, is adapted to rotate on at least a portion of the windings of the coil 14 and translate along the longitudinal axis thereof to vary the electrical inductance of the coil 14. In the present example of my invention, the screw 24 is adapted to translate at least partially into and out of the shaft 18 and coil 14. The screw 24 should be formed of an electrically conductive material suitable for shorting successive windings of the coil 14 together as the screw 24 rotates around and translates into the coil 14, such as aluminum alloy.

One end of the screw 24 is attached to a cap 26 of electrically conductive material such as aluminum alloy or brass, for example, which defines a socket 28 therein into which the vertical radio antenna 12 may be inserted. A suitable threaded fastener such as an allen head screw 30 may be tightened in a groove provided through the side of the cap 26 to secure the antenna 12 in the socket 28.

Also embedded in the mass 16 is a second coil 32 disposed in end-to-end relationship with the first coil 14. The second coil 32 is also formed of a plurality of windings of a suitable electrically conductive material such as copper wire. The opposing ends of the coils 14 and 32 are electrically connected together by a lead wire 34 embedded in the core of the mass 16. The coil 32 thus forms a primary winding series connected to the coil 14 which serves as a secondary winding.

At the bottom end of the mass 16, a suitable electrical terminal 36, which may consist of a cylindrical tube of metal or metal alloy is partially embedded in the mass 16 and is electrically connected by solder or otherwise to the lead wire 34. The terminal 36 projects through the center of the coil 32 out of the bottom of the mass 16 into a central portion of a threaded shaft 38 defined in a electrically conductive base 40. The base 40 is in turn, embedded partially into the bottom end of the mass 16 in a secure manner. Circular ribs **42*a* may be formed around the top of the base 40 to aid in providing a secure bond with the mass 16. The bottom winding of the coil 32 is soldered or otherwise electrically connected to the top of the base 40 thus forming the ground side of the primary winding of the assembly 10**.

The cap 26 is rigidly embedded into the top end of a cylindrically shaped sleeve 44. The latter defines a cylindrically shaped chamber 46 opening out onto the bottom end of the sleeve 44. Circular ribs **42*b* may be formed in the cap 26 to aid in obtaining a secure bond between the cap 26 and the material of the sleeve 44. The sleeve 44 is preferably formed of a suitable dielectric material such as that used to form the mass 16** and is adapted to fit around the latter in relatively close conforming rotatable relation therewith.

To inhibit the penetration of moisture through the bottom end of the sleeve 44 between the periphery of the mass 16 and the defining wall of the chamber 46 toward the top end 20, a slot 48 is formed in and around the periphery of the mass 16. The slot 48 may be of rectangular cross-section and opens out against the defining wall of the chamber 46. A resilient O-ring 50 of the usual well-known type is disposed in and around the slot 48 filling the same. The arrangement allows the sleeve 44 to rotate about the mass 16 while forming a barrier to restrain moisture from seeping to the top surface 20 of the mass 16 where it may further seep onto the screw 24 and short out or partially short out successive windings of the coil 14.

Referring now specifically to FIG. 3 there is shown means for repeatedly adjusting the assembly 10 to various desired inductance values within the inductance range of the coil 14 and screw 24 combination readily and accurately. This additional feature of my invention is particularly advantageous in using the assembly 10 to adjust the resonant frequency of the fixed length antenna 12 to various channels or wave lengths. A circular scale of graduations 52 is disposed around at least a portion of the periphery of the sleeve 44 at the bottom end thereof. A vertical index marker 54 is formed along surface of the mass 16 for tracking the graduations 52 of the scale as it rotates with the sleeve 44. The rotation of the screw 24 along a single winding of the coil 14 can thus be tracked quite accurately so that a given angular position of the screw 24 on the winding of the coil 14 can be repeated.

Not only does the assembly 10 provide for adjusting the screw 24 to a particular angular position of contact with the windings of the coil 14, a series of horizontal gradations 56 formed on the periphery of the mass 16 permits tracking of the translation of the sleeve 44, specifically the bottom end thereof, along the surface of the mass 16 as the screw 24 rotates on the windings of the coil 14. The gradations 56 may be spaced apart such that the bottom end of the sleeve 44 progresses between two successive gradations 56 for each complete rotation of the sleeve 44 about the mass 16. The assembly 10 may therefore be calibrated such that the number of gradations 56 visable below the bottom end of the sleeve 44 represents an equal number of windings of the coil 14 which are out of engagement with the shorting screw 24, or some multiple thereof.

Figure 4:
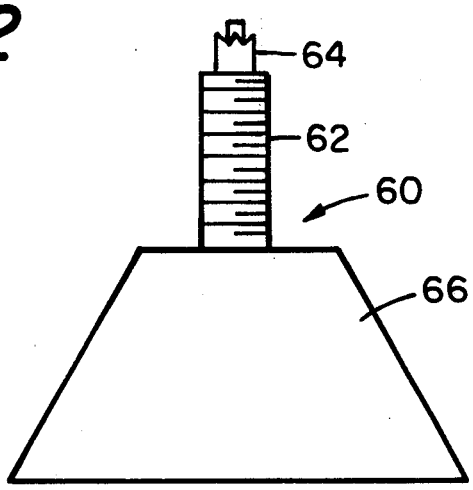
FIG. 4 is an elevation view of a base mounting assembly of conventional type illustrating one means of mounting the assembly of FIGS. 1-3.

Referring now to FIG. 4 there is shown a typical mounting assembly 60, in common usage in the art, which can be fastened in a conventional manner to the hood, roof or trunk lid of an automobile to provide means for installing the assembly 10 on the same. A threaded male plug 62 engages the threaded shaft 38 in the base 40 of the assembly 10 of FIG. 1. A suitable coaxial connector terminal 64 is mounted on the top of the plug 62 and is adapted to engage and electrically connect to the terminal 36 of the assembly 10 of FIG. 1. A base 66 contains the plug 62 and mounts directly onto the body of an automobile in any usual, well-known manner.

Figure 5:
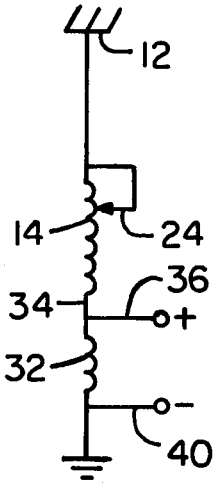
FIG. 5 is an electrical schematic diagram of the circuit formed by the assembly of FIGS. 1-3.

Referring now to FIG. 5 a schematic diagram is shown which illustrates the resulting electrical circuit of the assembly 10 of FIGS. 1–3, specifically the primary coil 32, the series connected secondary coil 14 and the shorting screw 24. The terminal 36 is shown as connected between the opposing ends of the coils 14 and 36, the same being electrically connected by the lead wire 34.

Figure 6:
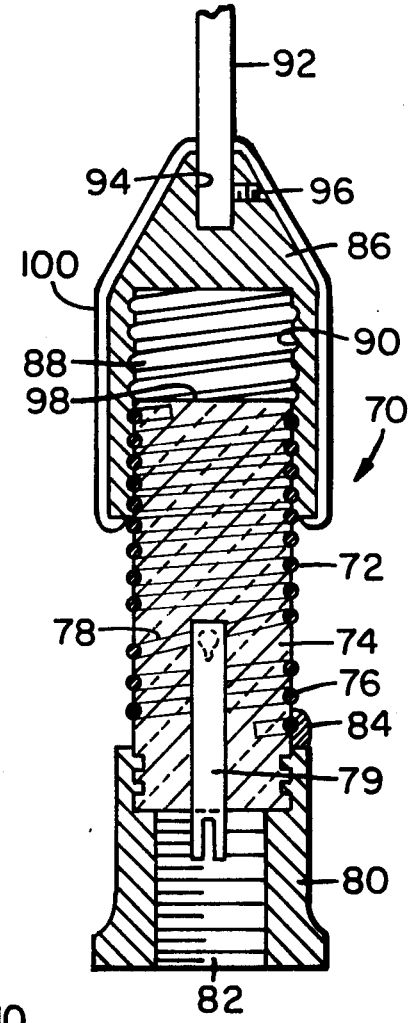
FIG. 6 is an elevation view of a tunable base loading coil assembly for a radio antenna illustrating another preferred embodiment of my invention.

Referring next to FIG. 6 there is shown, in another preferred embodiment of my invention an electrical component consisting of a tunable base loading coil assembly 70. Specifically, a first coil 72 of electrically conductive material such as copper wire is wound in the form of a helix on a cylindrical mass 74 or coil form made of electrically insulative dielectric material such as polycarbonate resin. A second coil 76 forming an inductively coupled input link to the first coil 72 is wound on the mass 74 below the coil 72. The coils 72 and 74 are electrically connected together on their opposing ends by a suitable lead wire 78. A terminal 79 is partially embedded in the mass 74 and connects electrically to the lead wire 78 by means of solder or otherwise. An electrically conductive metal base 80 is secured to a bottom portion of the mass 74. The base 80 defines a hollow shaft 82 therein, the defining wall of which may be threaded for joinder with a suitable terminal connector such as the type illustrated in FIG. 4 as previously explained. The base 80 may be electrically connected to the bottom end of the primary coil 76 by solder as at 84 or in any other convenient and well-known manner.

An adjustable shorting screw 86 constructed of a suitable electrically conductive material such as aluminum or brass, for example, defines a cylindrically shaped recess 88 opening onto the bottom and thereof. The vertical interior defining wall 90 of the recess 88 is threaded in conformity with the geometry of the coil 72, namely its pitch, spacing between windings and winding diameter so as to permit the screw 86 to rotate over and translate back and forth along the coil 72. The coil 72 thus is threadable into and out of the recess 88 to vary the inductance thereof. A radio antenna 92 may be securely fastened into a socket 94 formed in the screw 86 by a means of a threaded fastener inserted in the threaded port 96. The top 98 of the mass 74, and the coil 72, thus advance into the recess 88 as the screw 86 is rotated in one direction, and retracts from the top of the recess 88 as the screw 86 is rotated in the opposite direction. The screw 86 thus rotates on at least a portion of the windings of the coil 72 and translates along the longitudinal axis thereof to vary the electrical inductance of the coil 72. The screw 86 may be incapsulated in a mass 100 of suitable dielectric material to prevent a shock or burn to the user when the screw 86 is rotated by hand about the coil 72.

Although the subject invention has been described with respect to specific details of certain preferred embodiments thereof, it is not intended that such details limit the scope of my invention except only insofar as set forth in the following claims.

I claim:

1. An electrical component comprising a first coil of electrically conductive material having a plurality of windings, an adjustable shorting screw disposed in line with the longitudinal axis of said coil, said shorting screw being adapted to rotate on at least a portion of said windings and translate along said longitudinal axis to vary the electrical inductance of said coil, a mass of dielectric material defining a generally cylindrically shaped hollow shaft therein opening onto one end of said mass, at least a portion of said first coil being partially embedded in said mass around the defining wall of said shaft, said screw being adapted to translate at least partially into and out of said shaft and first coil, and a rotatable sleeve defining a hollow cylindrically shaped chamber therein opening onto one end of said sleeve, said mass having a cylindrically shaped surface adapted to fit at least partially in said chamber in relatively close conforming rotatable relation therewith, said screw being attached to the other end of said sleeve.

2. The electrical component of claim 1 wherein said sleeve comprises a cap of electrically conductive material forming said other end of said sleeve, and a dielectric material forming the remainder of said sleeve.

3. The electrical component of claim 2 further comprising means for electrically connecting a radio antenna to said cap.

4. The electrical component of claim 1 further comprising a circular scale of graduations disposed around at least a portion of the periphery of said sleeve on an end portion thereof at said one end of said sleeve, and an index marker formed on the periphery of said mass for tracking said scale as said sleeve rotates.

5. The electrical component of claim 4 further comprising a series of gradations formed on the periphery of said mass perpendicular to said index marker, said gradations being spaced apart so as to track the translation of said one end of said sleeve along the surface of said mass as said screw rotates on said windings.

6. The electrical component of claim 1 further comprising means for inhibiting the flow of moisture through said one end of said sleeve, between the periphery of said mass and the defining wall of said chamber, toward said other end of said sleeve.

7. The electrical component of claim 6 wherein said inhibiting means comprises a circular slot formed in the periphery of said mass and opening onto said chamber defining wall, and an O-ring disposed in said slot.

8. The electrical component of claim 1 further comprising a second coil of electrically conductive material having a plurality of windings disposed in end-to-end alignment with said first coil, the opposing ends of said coils being electrically connected together.

9. The electrical component of claim 8 further comprising terminal means for making an external electrical connection to said opposing ends of said coils.

10. The electrical component of claim 1 further comprising a second coil of electrically conductive material having a plurality of windings disposed in end-to-end alignment with said first coil and being embedded in said mass on the opposite side of said first coil from said one end of said mass, the opposing ends of said coils being electrically connected together through said mass, and terminal means partially projecting into the other end of said mass and being electrically connected through the center of said second coil to said opposing ends, for making an external electrical connection to said opposing ends.

11. The electrical component of claim 10 further comprising a base constructed of electrically conductive material fixedly attached to said other end of said mass, said terminal means projecting into an interior void defined by said base and being electrically insulated from said base.

* * * * *